United States Patent [19]

Ferguson et al.

[11] Patent Number: 4,923,372

[45] Date of Patent: May 8, 1990

[54] GAS LIFT TYPE CASING PUMP

[75] Inventors: Paul L. Ferguson, Tyler; Robert W. Dinning, Houston, both of Tex.

[73] Assignee: Ferguson Beauregard Inc., Tyler, Tex.

[21] Appl. No.: 297,068

[22] Filed: Jan. 13, 1989

[51] Int. Cl.[5] ..... F04B 47/12

[52] U.S. Cl. ..... 417/53; 417/60

[58] Field of Search ..... 417/53, 56–60

[56] References Cited

U.S. PATENT DOCUMENTS

| | | | |
|---|---|---|---|
| 2,143,450 | 1/1939 | Pippenger | 417/60 X |
| 2,812,717 | 11/1957 | Brown | 417/57 X |
| 3,941,511 | 3/1976 | Morgan | 417/58 X |
| 4,070,134 | 1/1978 | Gramling | 417/56 |
| 4,696,624 | 9/1987 | Bass et al. | 417/56 |

FOREIGN PATENT DOCUMENTS

| | | | |
|---|---|---|---|
| 0523801 | 4/1956 | Canada | 417/56 |

*Primary Examiner*—Leonard E. Smith
*Assistant Examiner*—Eugene L. Szczecina, Jr.
*Attorney, Agent, or Firm*—L. Dan Tucker

[57] ABSTRACT

A gas operated, plunger lift type pump for use in a subterranean well conduit which extends from a pool of well liquids to the surface comprises a tubular plunger slidably and sealingly mounted in the well conduit and defining a fluid flow passage through the tubular body. An annular valve seat is fixedly mounted within the tubular body and an axially shiftable valve head is engagable with the valve seat to prevent fluid flow through the fluid passage. The valve head is biased to an open position by a surface applied trapped fluid pressure which approximates the hydrostatic pressure existing in the well at the liquid level to which the plunger is permitted to descend, and is further retained in the open position by a latching collet. As the plunger rises in the well due to the gas pressure existing below the plunger, it will raise the fluids trapped above the plunger to discharge through vertically spaced discharge ports. The upward movement of the plunger is stopped to position the plunger intermediate two discharge ports, which permits equalization of fluid pressures above and below the plunger, thus permitting the shiftable valve head to return to an open position to initiate the return downward movement of the plunger.

23 Claims, 2 Drawing Sheets

GAS LIFT TYPE CASING PUMP

BACKGROUND OF THE INVENTION

1. Field of the Invention:

The invention relates to a gas lift type pump for oil and gas wells which utilizes relatively low gas pressures existing in a well conduit to effect the elevation of liquids in the well conduit to the surface.

2. DESCRIPTION OF PRIOR ART:

Gas lift type pumps have long been utilized in subterranean wells where the natural pressure existing in the well is insufficient to produce a free flow of gas and liquids to the surface. Such prior art devices incorporated a plunger element which is slidably and sealably engaged with the well conduit, which may be either the well casing or a tubing string extending from the well surface to the body of liquid accumulated in the bottom of the conduit. The plunger defines a vertically extending, internal passage bypassing the external seal on the plunger element. A valve mechanism is provided within the body of the plunger and is effective to close the internal passage when the plunger has reached a preselected depth in the accumulated liquids where the hydrostatic pressure is sufficient to effect the movement of the valve to its closed position. With the valve closed, the natural gas existing in the well accumulates below the plunger and acts on the plunger as a piston to move the plunger and all liquids located above the plunger to the well surface. A typical pump of this type is shown in GRAMLING patent #4,070,134.

The prior art devices, such as the GRAMLING gas lift pump have suffered from several disadvantages. In the first place, the closing of the valve when the plunger reaches the preselected depth in the well liquids is not positively effected, so that the valve may chatter between an open and closed position and thereby substantially reduce the upwardly directed gas forces operating on the plunger to move it to the well surface. Additionally, when the valve does close, a special mechanism has to be provided at the well surface to reopen the valve to permit the plunger to again descend into the well. Lastly, since the force holding the valve in its open position is primarily derived from the weight of the valve, the valve will always close when it has reached a minimum level in the well liquids where the hydrostatic pressure on the valve slightly exceeds the weight of the valve. This is a substantial disadvantage where the gas pressure in the well is sufficient to move a greater column of liquid upwardly through the well conduit. Thus the prior art devices are not susceptible to ready adjustment to accommodate the specific pressures and liquid depths found in various wells.

SUMMARY OF THE INVENTION

The method and apparatus of this invention contemplates the utilization of a plunger which is slidably and sealably mounted in a well conduit, such as the well casing, extending from the surface of the well to a preselected depth within the pool of liquid accumulating in the bottom of the well. A tubular body is slidably and sealably mounted in the well conduit by an external sealing element and defines a vertically extending internal fluid passage which bypasses the external sealing element engagable with the well conduit. Thus, the tubular body functions as a plunger which readily moves downwardly into the well until it reaches a stop previously mounted in the well which is at a predetermined depth relative to the accumulating liquids in the bottom of the well.

An annular valve seat surrounds the vertically extending internal passage in the tubular body and cooperates with an axially shiftable valve head to close the fluid passage when the plunger reaches a depth in the well fluids corresponding to a preselected hydrostatic pressure.

The valve head is biased to its open position by a bellows mechanism which is subjected at the surface to a preselected trapped fluid pressure which approximates the hydrostatic fluid pressure level at which it is desired that the valve close. In addition, the valve head is detachably secured in its open position by a latching mechanism such as a collet, so that the hydrostatic pressure force exerted on the valve head to move it to its closed position must be sufficient to not only overcome the downward bias of the trapped fluid pressure acting on the bellows but also to overcome the retention capability of the collet latching mechanism. When the well hydrostatic pressure reaches such a level, the valve head will shift to its closed position with a positive snap action and will be positively retained in its closed position by virtue of the fact that the effective area upon which the well hydrostatic pressure operates on the valve head exceeds the effective area of the bellows.

With the valve head in its closed position, the pressure forces of the well gases trapped beneath the plunger build up to a level sufficient to move the plunger, and all liquids trapped in the well conduit above the plunger, upwardly to the surface.

At the surface, a lubricator pipe is provided having two vertically spaced radial discharge ports. Chokes are provided in each of the two ports to provide a predetermined resistance to flow of fluids through such ports. As the plunger rises in the well, the trapped liquids above the plunger are discharged through both ports. As the plunger approaches the ports, the chokes maintain the hydrostatic pressure on the valve actuating mechanism so as to prevent its early opening. When the plunger moves upwardly into the lubricator pipe so that the external seal element on the plunger is disposed between two vertically spaced ports, the remaining liquid above the plunger is discharged through the upper port and the actuating gases bleed off through the lower port. The two radial discharge ports are interconnected by a pipe to equalize pressure between the two ports, thus equalizing pressures above and below the plunger and permitting the trapped fluid pressure operating on the bellows to return the valve head to its original, collet secured, open position and the plunger will immediately start on the next downward stroke in the well conduit.

The objects and further advantages of the method and apparatus embodying this invention will be readily apparent to those skilled in the art from the following detailed description, taken in conjunction with the annexed sheets of drawings, on which is shown a preferred embodiment of the invention.

DESCRIPTION OF PREFERRED EMBODIMENT

Figure 1:
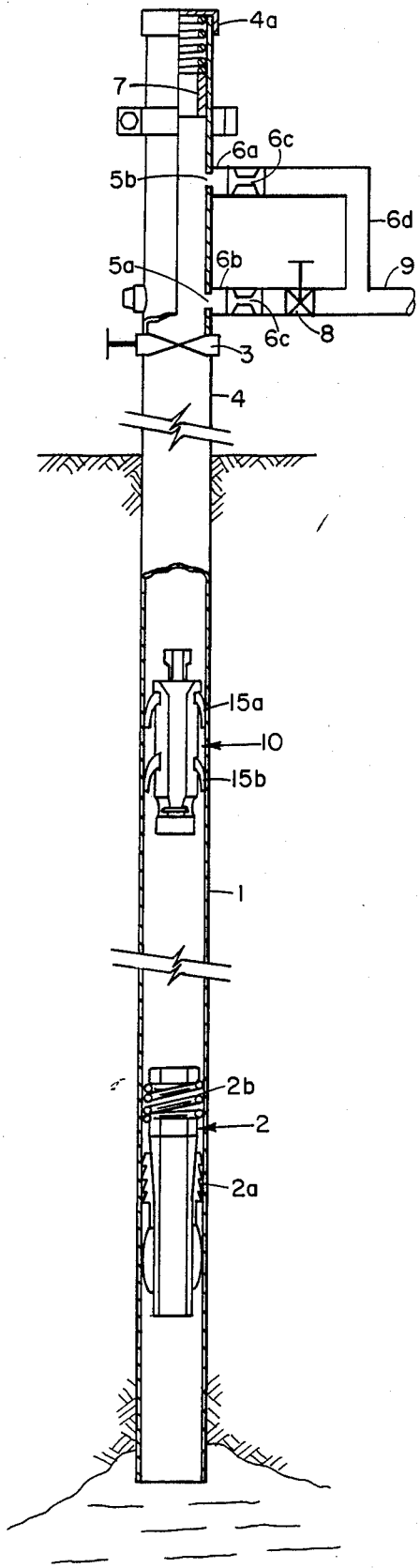
FIG. 1 is a schematic vertical sectional view of a complete well having a gas lift pump embodying this invention positioned in such well.

Referring to FIG. 1, there is schematically shown a complete subterranean well incorporating a gas operated plunger lift pump embodying this invention. The well comprises a casing 1 extending from the surface to a pool of liquid in the well with which the bottom end of the casing is in fluid communication by conventional screens or perforated pipe sections (not shown). In the bottom of the well casing 1, a stop mechanism 2 is mounted in conventional fashion by slips 2*a* and incorporates a spring 2*b* for arresting the downward movement of a plunger type pump unit 10 embodying this invention. The detailed construction of pump unit 10 will be hereinafter set forth.

At the top of the well, a knife valve 3 of the type having a smooth bore and sold by L & M VALVE COMPANY of Cleveland, Ohio is suitably secured to the casing 1 to effect the cut-off of fluids in the event that the retrieval of the pump 10 for inspection or repair is desired. Above the knife valve 3, a lubricator pipe 4 is provided having vertically spaced, radial discharge ports 5*a* and 5*b* communicating with pipes 6*a* and 6*b*. Choke elements 6*c* are placed in each of the pipes 6*a* and 6*b* to restrict flow through such ports and produce a back pressure approximating the well hydrostatic pressure at the lowest level reached by the pump 10.

A spring biased stop 7 is conventionally mounted in the top end of the lubricator pipe 4 and a conventional end cap 4*a* is detachably secured to the top end of the lubricator pipe 4. Additionally, the discharge ports 5*a* and 5*b* are pressure equalized by a connecting pipe 6*d*, and a shut-off valve 8 is incorporated in the pipe 6*a* leading from the lower discharge port 5*a*. The combined fluid flow through the ports 5*a* and 5*b* is then directed by piping 9 to a suitable storage tank or a separator unit (not shown).

A plunger type pump 10 is provided with one or more annular elastomeric sealing elements 15*a* and 15*b* slidably and sealably engaging the walls of the casing 1. The plunger type pump 10 reciprocates from a lower position determined by the spring stop 2 to an upper position abutting the upper spring stop 7 and effects the pumping of liquids from the liquid pool by utilization of the gas pressure commonly found in subterranean wells to elevate the plunger type pump 10 from the extreme lower position to its extreme upper position through the operation of a valving mechanism 30 incorporated within the plunger type pump 10, which is illustrated in the remaining figures of the drawings and will be described in detail.

The plunger type pump 10 has a tubular body assemblage 12. A pair of elastomeric seal cups 15*a* and 15*b* are conventionally mounted on the exterior of the pump body 12 in vertically spaced relationship. While both elastomeric seal elements 15*a* and 15*b* may be designed to effect a slidable sealing relationship with the bore of the well casing 1, preferably the upper elastomeric seal element 15*a* contacts the bore of casing 1 in sealing relationship while the lower elastomeric sealing element is of more rugged construction and is dimensioned to be spaced from contact with the bore of the casing 1. This construction provides for a faster rate of descent of the plunger type pump 10 in the casing 1. Additionally, the more rugged lower elastomeric seal element 15*b* functions as a centering device and protects the upper elastomeric sealing element 15*a* from excessive wear incurred in traversing the pipe joints commonly found in the casing 1 and passing through portions of the well casing 1 which are not exactly vertically aligned. Each of the annular elastomeric elements 15*a* and 15*b* are secured to the exterior of the tubular body assemblage 12 by mounting rings 15*c* to which the top end of the particular annular elastomeric element is bonded. Such rings abut respectively against upwardly facing shoulders 12*a* and 12*b* provided on the exterior of the tubular body assemblage 12 and are secured in abutting position by downwardly facing shoulders 12*c* and 12*d* respectively provided on structural elements of the tubular body assemblage 12. Additionally, O-rings 15*e* effect the sealing of the annular elastomeric elements 15*a* and 15*b* relative to the exterior of the tubular body assemblage 12.

The tubular body assemblage 12 of the plunger type pump unit 10 comprises, from the top down, a wireline engagable sub 12*e* having a fishing neck 12*f* traversed by ports 12*y*. The sub 12*e* is threadably secured to the top end of an upper body sleeve 12*g* by threads 12*h* and sealed by seal ring 12*t*.

The lower end of upper body sleeve 12*g* is provided with internal threads 12*j* by which it is secured to the top end of a intermediate body sleeve 12*k*. The lower end of the intermediate body sleeve 12*k* is provided with external threads 12*m* which threadably engage a lowermost body sleeve 12*n* and are sealed by O-ring 12*x*. The bottom end of the lowermost body sleeve 12*n* is provided with internal threads 12*p* which threadably engage a cup-shaped closure element 12*q*. The lowermost body sleeve 12*n* is further provided with peripherally spaced slots 12*r* providing communication between the bore of the casing 1 and the interior of the tubular body assemblage 12.

Additionally, the lowermost body sleeve 12*n* is provided with an internally projecting shoulder 12*s* and such shoulder functions to secure an annular valve seat ring 14 in position. Above shoulder 12*s*, a space out sleeve 16 is provided which abuts a peripheral notch 32*a* formed on a flanged tubular bottom element 32 forming the bottom end of a valve actuator housing 30. The peripheral flange 32*b* has its upwardly facing surface 32*c* in abutment with the lower end of the intermediate body sleeve 12*k*. Thus, both the valve seat ring 14 and the entire valve actuating housing 30 are clamped in position by tightening of the threads 12*m* between the intermediate body sleeve 12*k* and the lowermost body sleeve 12*n*.

The bottom flanged element 32 is further provided with a plurality of peripherally spaced ports 32*d* through which fluid can flow axially through the tubular body assemblage 10 in the annulus 20 defined between the bore of tubular body assemblage 10 and the exterior of the valve actuator assembly 30.

The upper end of the tubular bottom element 32 is provided with external threads 32*e* which engage the lower end of a housing sleeve 34. This threaded connection is sealed by a pair of O-rings 32*f*. The upper end of the housing sleeve 34 is of reduced diameter an is provided with external threads 34*a* and internal threads 34*b*. The external threads are secured to the bottom end of a top sub 36 and this threaded connection is sealed by O-rings 34*c*. Top sub 36 defines a fluid pressure chamber or dome 36a in its medial portions and has a reduced diameter upper end portion 36b defining a constricted bore 36c extending into the chamber 36a. A check valve 37 similar to those employed in automobile tires is mounted in the constricted portion of the bore 36c and a plug 36d is threadably secured in internal threads 36e of a counterbore 36f and sealed thereto by O-ring 36g.

Figure 3:
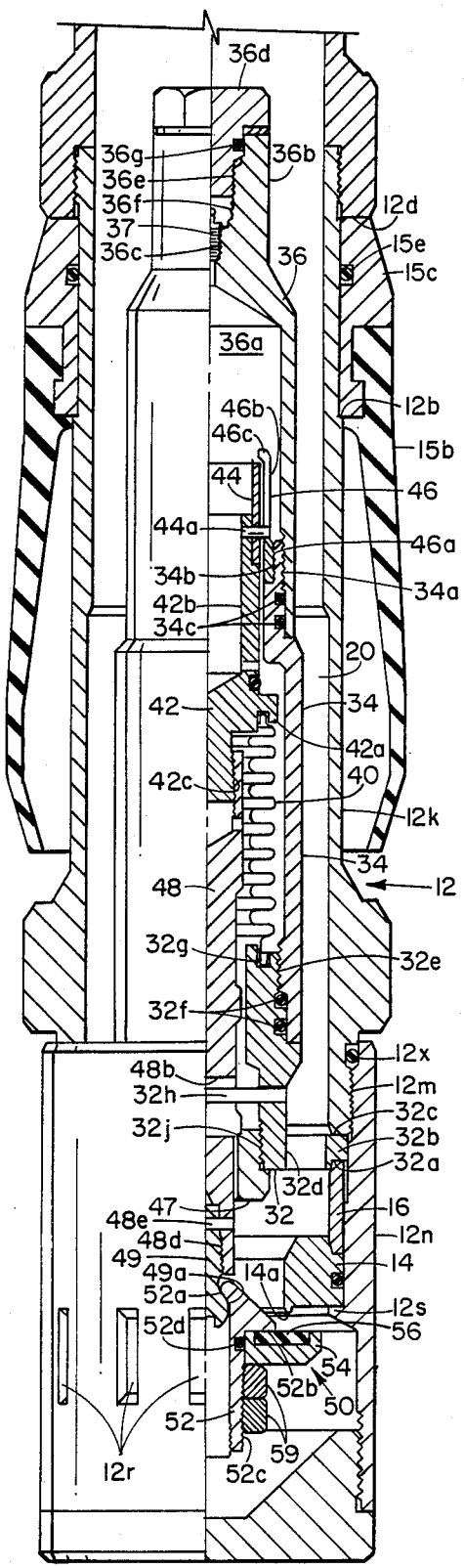
FIG. 3 is a view similar to FIG. 2B but with the internal valve mechanism shown in section and in its open position.
Figure 2A:
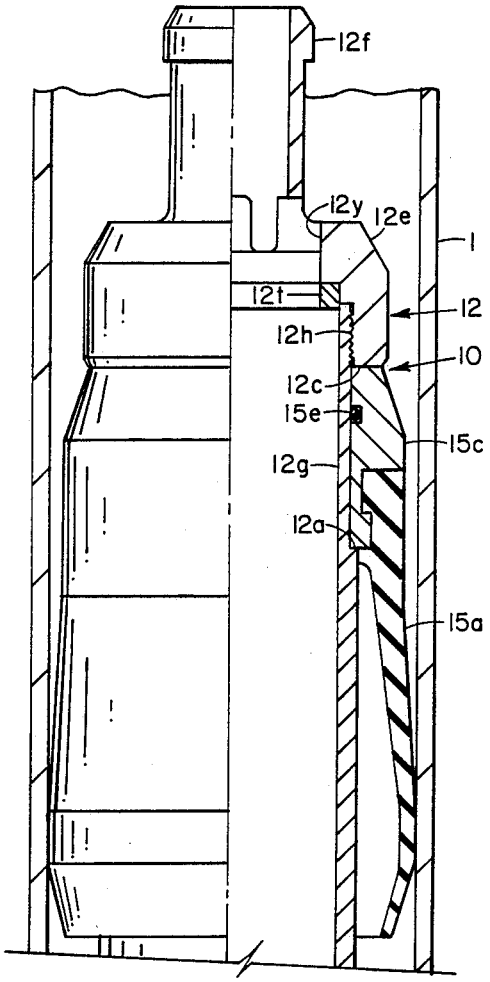
FIGS. 2A and 2B collectively constitute a vertical quarter sectional view of a plunger for a gas lift type pump embodying this invention with the internal valve mechanism shown in elevation.
Figure 2B:
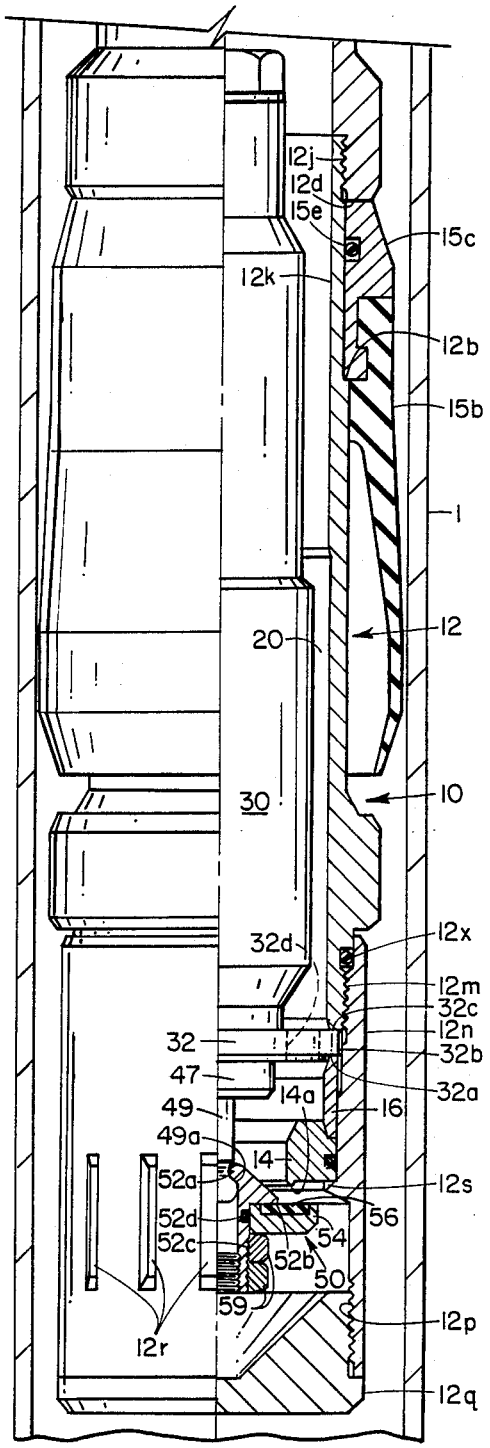

The bottom tubular flanged element 32 is further provided with a upwardly facing slot 32g within which the end of a bellows 40 is sealably secured in a suitable manner, as by welding. The upper end of bellows 40 is similarly secured to an enlarged shoulder 42a provided on an actuator stem 42. The upper portion 42b of actuator stem 42 has a collet engaging sleeve 44 secured thereto by one or more radial pins 44a which project beyond the external periphery of the sleeve 44. A valve head retaining collet 46 has a ring portion 46a externally threaded to engage in the internal threads 34b of the valve sleeve 34 and the radial pins 44a project between the arms 46b of the collet 46 to prevent the collet from unscrewing from the valve sleeve 34. The enlarged collet heads 46c overlie the end of collet engaging sleeve 44 in the run-in or open position of the valve assemblage 30, as shown in FIG. 3.

The actuator stem 42 is provided with external threads 42c on its lower end which threadably engage internal threads provided on a valve mandrel 48 which extends downwardly through the valve sleeve 34, the tubular flanged bottom element 32 and at least into the valve seat ring 14. Mandrel 48 is provided with one or more axially extending slots 48b which respectively receive radially disposed pins 32h which are pressed into appropriate radial bores provided in the flanged lower element 32. This pin and slot connection prevents relative rotation between the connected elements.

A stop for the downward movement of the valve actuator mandrel 48 to prevent excessive compression of the bellows 40 is provided by a guide bushing 47 threadably secured in the bottom end of the bore of the flanged lower element 32 by threads 32j. The guide sleeve 47 cooperates with the external surface of the actuator mandrel 48 in a non-sealed, bearing relationship. Thus, fluid entering the interior of the tubular body 10 through the axial slots 12r or the upwardly open annulus 20 can pass freely to surround the internal surfaces of the annular bellows 40 and thereby exert well hydrostatic pressure on such internal surfaces to axially expand the bellows 40 and thus move the valve actuator mandrel 48 upwardly.

A valve head assemblage 50 is secured to the bottom end 49a of a support sleeve 49 which is threadably secured to the bottom end of actuator mandrel 48 by threads 48d and the threaded connection is secured by a pin 48e. The bottom 49a of the support sleeve 49 has an external convex configuration which cooperates with a concave surface 52a provided on the upper end of a seal body sleeve 52. Thus, the seal body sleeve 52 may freely swivel relative to the valve actuator mandrel 48. Seal mounting sleeve 52 is provided with a downwardly facing shoulder 52b against which an annular seal holder 54 is compressed by a pair of nuts 59 engaging external threads 52c formed on the lower portions of the seal mounting sleeve 52. The threaded connection is sealed by an O-ring 52d. The seal holder 54 mounts an annular elastomeric ring 56 which is engagable with the depending seal rib 14a provided on the rigidly mounted seal ring 14. It necessarily follows that upward movement of the actuator mandrel 48 will bring the annular elastomeric seal mass 56 into intimate sealing engagement with a depending sealing rib 14a formed on valve seat ring 14.

The operation of the foredescribed plunger type pump will be readily apparent to those skilled in the art. The pump is, of course, only utilized in wells where a significant amount of gas is produced in the formation to which the casing 1 extends. The gas pressure is, however, not sufficient to force any liquids existing in the well up to the surface. Thus, in the event that such liquids are hydrocarbons, they cannot be recovered except through the installation of a conventional sucker rod or submersible pump with the attendant large capital expense and the requirement for daily inspection and maintenance of the pumping unit. In wells primarily producing gas, the production may be substantially impaired by liquids accumulating in the bottom of the well, whether such liquids are hydrocarbons or saltwater. In either event, it is highly desirable to effect the removal of liquids from the bottom of the well without the necessity of installing conventional pumping units.

Prior to installing the pump unit 10 in the well, a trapped gas pressure is applied to the exterior surfaces of the bellows 40 by removing the plug 36d and effecting a conventional hose connection to the threads 36e with a source of pressured gas which may be air, nitrogen or other inert gas. Such gas not only fills the chamber surrounding the bellows 40 but also fills the dome chamber 36a and is brought to a pressure approximating the anticipated well hydrostatic pressure when the pump unit 10 is positioned on the lower spring stop 2, which is positioned below the liquid level in the well. The gas supplied is trapped by check valve 37. The plug 36d is replaced and pump unit 10 is then inserted through the top end of the lubricator pipe by the removal of the end cap 4a and the upper spring stop 7. The pump unit 10 will proceed to slide downwardly through the well casing 1 with the valve head 52 biased by bellows 40 to its open position, in which it is retained by collet 46, thus maintaining an open passage for well fluids through the body assemblage 12 of the pump unit 10.

Pump unit 10 thus proceeds downwardly in the well casing until it either encounters the bottom well stop 2 or reaches a sufficient depth in any fluids existing in the well casing to produce a hydrostatic pressure substantially in excess of the trapped fluid pressure operating on the bellows 40. Such hydrostatic pressure must be greater than the trapped bellows pressure due to the fact that the valve actuating mechanism is also restrained against upward movement by the collet 46. When such level of hydrostatic pressure is achieved, the collet 46 will release and the valve head assembly 50 will move to a closed position with a snap action. It should be noted that in its closed position, the effective area of the valve head 50 upon which the hydrostatic pressure is acting is substantially greater than the effective area of the trapped fluid pressure existing in the bellows unit 40, thus assuring that once closed, the valve would remain closed until a substantial reduction in well hydrostatic fluid pressure is produced.

The pump 10 will then be moved upwardly by the pressure of the gases generated in the well acting on the entire cross-sectional area of the pump unit 10 as defined by the maximum diameter of the upper annular elastomeric seal unit 15a. If this gas pressure is not sufficient to initiate the movement of the pump 10, it will remain in its lower position while the gas pressure gradually builds up to a level sufficient to elevate the pump unit 10. When the pump unit 10 moves upwardly, all of the well fluid trapped above the pump unit 10 will be moved with it, thus maintaining the same hydrostatic pressure on the interior of the bellows 40 so that there is no effective force generated sufficient to shift the valve head 50 from its closed position.

As the plunger unit approaches the top of the well, it will be observed that the trapped fluids carried upwardly by the pump 10 will be discharged through the vertically spaced discharge ports 5*a* and 5*b*. The chokes 6 provided in such discharge ports create an effective back pressure so that the hydrostatic pressure exerted on the pump unit 10 from above is not substantially reduced until the upper annular elastomeric seal unit 15*a* passes over the lower discharge port 6*b* and engages the upper stop 7. In this position, the gas pressure which has been urging the pump unit 10 upwardly is dissipated through the lower discharge port 5*b* and supplied to a separator tank through the pipe 9. Since the pressures at the two discharge ports are substantially equalized by the connecting conduit 6*d*, a point will be reached wherein the hydrostatic pressure exerted on one side of the bellows 40 will decrease below the trapped fluid pressure acting on the other side of the bellows 40, hence the bellows will expand and shift the valve actuator 48 and the valve head 50 to its open position. This permits the pump unit to again pass downwardly through the well casing to begin another cycle of pumping action.

While this invention has been described in connection with its application as a casing pump, a pump 10 embodying the method and apparatus of this invention could obviously be utilized in any conduit, such as a tubing string, which extends from a pool of liquids in the bottom of a well to the well surface. Utilizing the casing as the fluid conduit provides a maximum effective piston area upon which the well gases can operate, hence requires less effective well gas pressure to produce the pumping action than would be the case with a smaller diameter conduit.

The foredescribed plunger type pump construction has the further advantage that the valving mechanism 30 may be removed as a unit from the interior of the valve body assemblage 12 and replaced in another unit. Furthermore, the same size valve mechanism may be utilized in different sizes of pump body assemblies, thus reducing the need for maintaining an inventory of different sizes of valve mechanisms in order to provide a pump for each of a plurality of different sized casings.

Removal of the pump unit 10 from the well may be conveniently accomplished by closing th knife valve 3 when the pump unit 10 is in its upper position. The end cap 4*a* on the lubricator pipe 4 may then be removed, together with the spring stop 7, and the entire valve pump unit 10 pulled out of the lubricator pipe.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A gas operated, plunger lift type pump for use in a subterranean well conduit extending from a pool of well liquids to the surface comprising, in combination:

a tubular body freely insertable in the bore of the well conduit and defining a vertically extending fluid passage;

annular elastomeric seal means sealingly mounted on the exterior of said tubular body and slidably and sealably engagable with the well conduit;

a valve seat fixedly mounted within said tubular body;

a shiftable valve head engagable with said valve seat to prevent fluid flow through said fluid passage in said tubular body;

trapped fluid pressure means for biasing said shiftable valve head to an open position relative to said valve seat;

means for latching said valve head in said open position relative to said valve seat, said latching means being releasable by a predetermined force on said valve head; and actuator means responsive to a selected level of well hydrostatic pressure for applying said predetermined force to said valve head to shift said valve head from said open position spaced from said seat to a closed position at a selected level in the liquid pool, whereby said tubular body will slide down the well casing to a depth in said liquid pool producing said selected level of hydrostatic pressure where said valve head is released from said latching means to engage said valve seat to close fluid flow through said fluid passage in said tubular body, thus permitting the gas pressure in the well below said tubular body to lift said tubular body and any trapped fluid above said tubular body to the well surface.

2. The apparatus of claim 1 wherein the effective area of said actuator means to which well hydrostatic pressure is applied is substantially less than the effective area of said valve seat, thereby imposing a biasing force on said valve head in said closed position to maintain said valve head in said closed position throughout upward travel of said tubular body to the well surface.

3. The apparatus defined in claim 1 further comprising a lubricator pipe attached at the surface to the top end of the well conduit;

said lubricator pipe having a pair of vertically spaced discharge ports separated by a distance greater than the axial length of said annular elastomeric seal means;

means in the top end of said lubricator pipe for arresting the upward movement of said tubular body with said elastomeric seal means disposed intermediate said discharge ports, whereby fluids lifted by said tubular body will discharge through both said discharge ports until said elastomeric seal means passes over said upper discharge port and thereafter the remaining fluid above said elastomeric seal means will discharge through said upper discharge port and the pressured gas beneath said elastomeric seal means will discharge through said lower discharge port.

4. The apparatus of claim 1 wherein said valve seat comprises an annular rib;

said valve head comprising a disc shaped member carrying an annular elastomeric seal engagable with said annular rib;

an actuator rod connected to said actuator means and projecting toward said annular valve seat; and a spherical segment joint securing said valve head to said actuator rod, thereby assuring full peripheral engagement of said annular elastomeric seal with said annular rib.

5. The apparatus of claim 1 wherein said latch means comprises a collet having a ring portion secured within said tubular body and peripherally spaced latching heads normally engaged with said actuator means to secure said valve head in said open position.

6. The apparatus of claim 3 further comprising choke means in said radial discharge ports to maintain the hydrostatic pressure level acting on said actuator means as said tubular body approaches said lubricator pipe.

7. A gas operated, plunger lift type pump for use in a subterranean well conduit extending from a pool of well liquids to the surface comprising, in combination:

a tubular body freely insertable in the bore of the well conduit and defining a vertically extending fluid passage;

annular elastomeric seal means sealingly mounted on the exterior of said tubular body and slidably and sealably engagable with the conduit;

a valve seat fixedly mounted within said tubular body adjacent said fluid passage;

a shiftable valve head engagable with said valve seat to prevent fluid flow through said fluid passage in said tubular body;

valve actuating means within said tubular body for shifting said valve head between an open and a closed position relative to said valve seat;

said valve actuating means comprising a hollow bellows having interior and exterior surfaces;

means exposing one of said interior and exterior surfaces to well hydrostatic pressure;

means exposing the other of said interior and exterior surfaces to a trapped, surface applied fluid pressure of a level adequate to maintain said valve head in said open position during the descent of said tubular body in the well casing to a preselected level in the liquid pool where the well hydrostatic pressure exceeds the said trapped fluid pressure and operates to shift said valve head to said closed position, thereby permitting the gas pressure in the well conduit below said tubular body to lift said tubular body and any trapped fluid above said tubular body to the well surface.

8. The apparatus of claim 7 wherein said bellows has an annular configuration for coaxial mounting within said tubular body, the cross-sectional area of said annular bellows being less than the effective area of said valve seat, whereby the axial shifting of said valve head to said closed position imposes a greater force on said valve head by well hydrostatic pressure than the opposing force exerted on said valve head by said bellows.

9. The apparatus defined in claim 7 further comprising a lubricator pipe attached at the surface to the top end of the well conduit;

said lubricator pipe having a pair of vertically spaced discharge ports separated by a distance greater than the axial length of said annular elastomeric seal means;

means in the top end of lubricator pipe for arresting the upward movement of said tubular body with said elastomeric seal means disposed intermediate said discharge ports, whereby fluids lifted by said tubular body will discharge through both said discharge ports until said elastomeric seal means passes over said lower discharge port and thereafter the remaining fluid above said elastomeric seal means will discharge through said upper discharge port and the pressured gas beneath said elastomeric seal means will discharge through said lower discharge port; and conduit means for equalizing fluid pressures at said discharge ports.

10. The apparatus defined in claim 7 further comprising latching means for securing said valve head in said open position, said latching means being disengagable from said valve head only by a well hydrostatic pressure substantially in excess of the surface applied trapped fluid pressure acting on said bellows, thereby producing a snap seating of said valve head on said valve seat.

11. The apparatus of claim 7 wherein said valve seat comprises an annular rib;

said valve head comprising a disc shaped member carrying an annular elastomeric seal engagable with said annular rib;

an actuator rod connected to said actuator means and coaxially aligned with said annular valve seat; and a spherical segment joint securing said valve head to said actuator rod, thereby assuring full peripheral engagement of said annular elastomeric seal with said annular rib.

12. The apparatus of claim 7 wherein said latch means comprises a collet having a ring portion secured within said tubular body and peripherally spaced latching heads normally engaged with said actuator means to secure said valve head in said open position.

13. The apparatus of claim 9 further comprising choke means in said radial discharge ports to maintain the hydrostatic pressure level acting on said actuator means as said tubular body approaches said lubricator pipe.

14. A gas operated, plunger lift type pump for use in cased subterranean wells comprising, in combination:

a tubular body freely insertable in the bore of a well casing and having a vertical bore defining a fluid passage;

annular elastomeric seal means sealingly mounted on the exterior of said tubular body and slidably and sealably engagable with the well casing;

an annular valve seat fixedly mounted within said tubular body in surrounding relation to said fluid passage;

a vertically shiftable valve head engagable with said valve seat to prevent fluid flow through said tubular body;

valve actuating means within said tubular body for biasing said valve head vertically to an open position relative to said valve seat;

said valve actuating means comprising a hollow bellows having interior and exterior surfaces;

means exposing one of said interior and exterior surfaces to well hydrostatic pressure;

means exposing the other of said interior and exterior surfaces to a trapped, surface applied fluid pressure of a level adequate to maintain said valve head in said open position during the descent of said tubular body in the well casing to a preselected level where the well hydrostatic pressure exceeds the said trapped fluid pressure and operates to shift said valve head to said closed position, thereby permitting the gas pressure in the well casing to lift said tubular body and the trapped fluid above said tubular body to the well surface.

15. The apparatus of claim 14 wherein said bellows has an annular configuration for coaxial mounting within said tubular body, the cross-sectional area of said annular bellows being less than the effective area of said valve seat, whereby the axial shifting of said valve head to said closed position imposes a greater force on said valve head by well hydrostatic pressure than the opposing force exerted on said valve head by said bellows.

16. The apparatus defined in claim 14 further comprising a lubricator pipe attached at the surface to the top end of the well conduit;

said lubricator pipe having a pair of vertically spaced discharge ports separated by a distance greater than the axial length of said annular elastomeric seal means;

means in the top end of said lubricator pipe for arresting the upward movement of said tubular body with said elastomeric seal means disposed intermediate said discharge port, whereby fluids lifted by said tubular body will discharge through both said discharge ports until said elastomeric seal means passes over the lower one of said discharge port, when the remaining fluid above said elastomeric seal means will discharge through said upper discharge port and the pressured gas beneath said elastomeric seal means will discharge through said lower discharge port; and conduit means for equalizing fluid pressures at said discharge ports.

17. The apparatus defined in claim 14 further comprising latching means for securing said valve head in said open position, said latching means being disengagable from said valve head only by a well hydrostatic pressure substantially in excess of the surface applied trapped fluid pressure acting on said bellows, thereby producing a snap seating of said valve head on said valve seat.

18. The apparatus of claim 14 wherein said valve seat comprises an annular rib;

said valve head comprising a disc shaped member carrying an annular elastomeric seal engagable with said annular rib;

an actuator rod connected to said actuator means and coaxially aligned with said annular valve seat; and a spherical segment joint securing said valve head to said actuator rod, thereby assuring full peripheral engagement of said annular elastomeric seal with said annular rib.

19. The apparatus of claim 14 wherein said latch means comprises a collet having a ring portion secured within said tubular body and peripherally spaced latching heads normally engaged with said actuator means to secure said valve head in said open position.

20. The apparatus of claim 16 further comprising choke means in said radial discharge ports to maintain the hydrostatic pressure level acting on said actuator means as said tubular body approaches said lubricator pipe.

21. The apparatus of claims 1, 7 or 14 wherein said annular elastomeric seal means comprises:

a pair of cup shaped elastomeric elements mounted on said tubular body in vertically spaced relationship;

the uppermost cup shaped element having a peripheral surface sealingly engagable with the well conduit;

the lower cup shaped element being less flexible than the uppermost cup shaped element and having a peripheral surface disposed adjacent to, but not sealingly engaged with the well conduit.

22. The method of extracting hydrocarbon liquids from a subterranean well producing a mixture of hydrocarbon liquids and gases at a pressure level insufficient to produce free flow of the hydrocarbon liquids to the surface comprising the steps of:

providing a plunger which is slidably and sealably engagable with the well casing bore;

providing in said plunger a vertical fluid passage, a shiftable valve head for closing said fluid passage, and pressure means, including a fluid receiving chamber, for biasing said valve head to an open position relative to said fluids passage; said pressure means being shiftable by a selected well hydrostatic pressure to move said valve to a closed position;

filling said fluid receiving chamber with a trapped fluid pressurized to a level approximating the well hydrostatic pressure at a selected depth; and permitting the plunger to freely fall in the well casing to a pre-selected depth in the hydrocarbon liquids in the well, whereby said passageway is closed by said valve head and gas pressure beneath the plunger elevates the plunger to the surface.

23. The method of claim 22 further comprising providing a lubricator pipe at the top of the well casing to arrest the upward movement of the plunger; and concurrently draining liquids above the plunger and gases below the plunger through vertically spaced ports in the lubricator pipe to equalize fluid pressures on said plunger to permit the shiftable valve head to return to an open position.

* * * * *